US007497877B2

(12) United States Patent
Goedhart et al.

(10) Patent No.: US 7,497,877 B2
(45) Date of Patent: Mar. 3, 2009

(54) SOLVENT CLEANING PROCESS

(75) Inventors: Machial Goedhart, Olivier van Noortlaan (NL); Joel Luckman, Benton Harbor, MI (US); Hank Robert Reinhoudt, Olivier van Noortlaan (NL); Jan Hendrik Verbeek, Olivier van Noortlaan (NL); Vicki Lyn Wyatt-Smith, Watervliet, MI (US); Brian W. May, St. Joseph, MI (US); Mark B. Kovich, St. Joseph, MI (US); Tremitchell Wright, Elkhart, IN (US); Daniel C. Conrad, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 668 days.

(21) Appl. No.: 10/734,027

(22) Filed: Dec. 11, 2003

(65) Prior Publication Data

US 2005/0126606 A1 Jun. 16, 2005

(51) Int. Cl.

| | |
|---|---|
| ***C11D 3/00*** | (2006.01) |
| ***D06L 1/04*** | (2006.01) |
| ***A01H 5/02*** | (2006.01) |
| ***A01H 5/00*** | (2006.01) |
| ***D06F 35/00*** | (2006.01) |

(52) U.S. Cl. ..... 8/137; 8/142; 8/158; 68/18 C; 68/18 F; 68/18 R; 210/167.01; 210/167.5; 210/391; 210/663

(58) Field of Classification Search ..... 8/142, 8/158, 137; 68/18 C, 18 F, 18 R; 210/167.01–167.25, 210/391, 663

See application file for complete search history.

(56) References Cited

U.S. PATENT DOCUMENTS

| | | | | |
|---|---|---|---|---|
| 3,163,028 | A | | 12/1964 | De Pas et al. |
| 3,733,267 | A | | 5/1973 | Haase |
| 3,831,754 | A | * | 8/1974 | Heskett ..... 210/676 |
| 3,929,678 | A | | 12/1975 | Laughlin et al. |
| 4,086,705 | A | * | 5/1978 | Wehr ..... 34/469 |
| 4,169,856 | A | | 10/1979 | Cocuzza et al. |
| 4,331,525 | A | | 5/1982 | Huba et al. |
| 4,421,794 | A | | 12/1983 | Kinsley, Jr. |
| 4,555,344 | A | | 11/1985 | Cussler |
| 4,664,754 | A | | 5/1987 | Caputi et al. |
| 4,828,701 | A | * | 5/1989 | Cussler ..... 210/634 |
| 4,828,710 | A | | 5/1989 | Itoh et al. |

(Continued)

FOREIGN PATENT DOCUMENTS

| | | |
|---|---|---|
| EP | 0 648 521 A2 | 4/1995 |

(Continued)

*Primary Examiner*—Michael Barr
*Assistant Examiner*—Rita R Patel
(74) *Attorney, Agent, or Firm*—Clifton Green; Michael D. Lafrenz

(57) ABSTRACT

An improved solvent cleaning process of cleaning a non-aqueous solvent used in a dry cleaning process for fabrics including consecutive wash cycles for washing respective fabrics batches, including a basic solvent refining cycle and a first advanced solvent refining cycle, the basic solvent refining cycle including a step of separating solvent into a first solvent fraction and a second solvent fraction which is less clean than the first fraction, wherein the basic and first advanced solvent refining cycles are independently effected when solvent to be cleaned fulfils a respective predetermined condition.

20 Claims, 1 Drawing Sheet

U.S. PATENT DOCUMENTS 4,879,888 A * 11/1989 Suissa ..... 68/18 C
5,258,123 A * 11/1993 Huang et al. ..... 210/663
5,300,197 A 4/1994 Mitani et al.
5,340,443 A 8/1994 Heinio et al.
5,360,547 A 11/1994 Cockett et al.
5,460,018 A 10/1995 Werner et al.
5,486,410 A 1/1996 Groeger et al.
5,498,266 A * 3/1996 Takagawa et al. ..... 8/142
5,518,624 A 5/1996 Filson et al.
5,653,873 A * 8/1997 Grossman ..... 210/149
5,741,581 A 4/1998 DesMarais et al.
5,858,119 A * 1/1999 Mayne ..... 134/32
5,943,720 A * 8/1999 Chung ..... 8/158
5,962,390 A * 10/1999 Flynn et al. ..... 510/286
6,027,651 A 2/2000 Cash
6,045,588 A * 4/2000 Estes et al. ..... 8/142
6,063,135 A * 5/2000 Berndt et al. ..... 8/142
6,258,130 B1 7/2001 Murphy
6,309,425 B1 10/2001 Murphy
6,451,066 B2 9/2002 Estes et al.
6,475,968 B1 11/2002 Murphy et al.
6,591,638 B2 7/2003 Estes et al.
6,766,670 B2 7/2004 Estes et al.
6,846,790 B2 1/2005 Evers et al.
6,900,166 B2 5/2005 Evers et al.
2002/0056163 A1 5/2002 Estes
2003/0097718 A1 5/2003 Evers et al.
2003/0196277 A1 10/2003 Hallman et al.
2004/0088795 A1 5/2004 Orchowski et al.
2004/0088846 A1 5/2004 Murphy et al.
2004/0117919 A1 6/2004 Conrad et al.
2004/0139555 A1* 7/2004 Conrad et al. ..... 8/137
2005/0034246 A1 2/2005 Reinhoudt et al.
2005/0037938 A1 2/2005 Reinhoudt et al.
2005/0043196 A1 2/2005 Wright et al.
2005/0071928 A1 4/2005 Wright et al.
2005/0091755 A1* 5/2005 Conrad et al. ..... 8/137
2005/0091756 A1 5/2005 Wright et al.
2005/0091757 A1 5/2005 Luckman et al.
2005/0092033 A1 5/2005 Luckman et al.
2005/0092352 A1 5/2005 Luckman et al.
2005/0096243 A1 5/2005 Luckman et al.
2005/0126606 A1 6/2005 Goedhart et al.
2005/0132502 A1 6/2005 Goldoni et al.
2005/0133462 A1* 6/2005 Goldoni et al. ..... 210/767
2005/0150059 A1 7/2005 Luckman et al.
2005/0155393 A1 7/2005 Wright et al.
2005/0222002 A1 10/2005 Luckman et al.
2005/0257812 A1 11/2005 Wright et al.
2005/0263173 A1 12/2005 Luckman et al.
2006/0260064 A1 11/2006 Luckman et al.
2006/0260065 A1 11/2006 Wright et al.

FOREIGN PATENT DOCUMENTS

WO 00/26206 2/2000
WO 02/46517 A1 6/2002

* cited by examiner

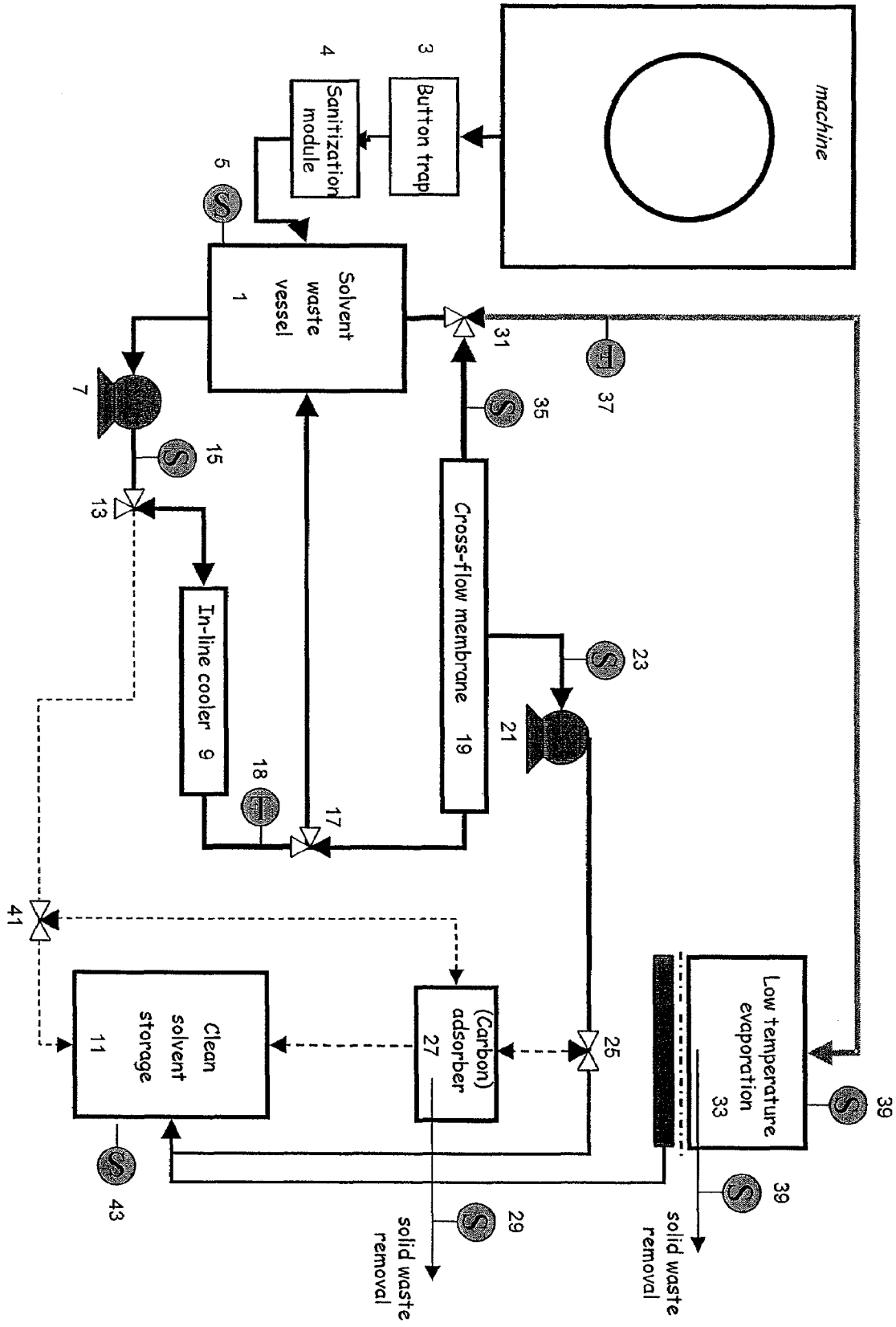
machine
3
Button trap
4
Sanitization module
5
Solvent waste vessel 1
31
37
35
7
15
13
In-line cooler 9
18
17
Cross-flow membrane 19
23
21
41
Clean solvent storage 11
43
(Carbon) adsorber 27
25
29
solid waste removal
Low temperature evaporation 33
39
39
solid waste removal

SOLVENT CLEANING PROCESS

FIELD OF THE INVENTION

The present invention relates to a solvent cleaning process suitable for use in a dry cleaning method such as an in-home dry cleaning process, in particular for cleaning articles, preferably laundry articles, and especially using siloxane solvents.

BACKGROUND OF THE INVENTION

Many alternative solvents have been proposed to replace perchoroethylene. Liquid carbon dioxide is one example, but the high-pressure equipment needed for this inorganic solvent makes it unpractical and prohibitively expensive. A novel and more promising class of dry cleaning solvents are the so-called non-flammable, non-chlorine containing organic solvents. Examples may include hydrofluoroethers such as nonafluoromethoxybutane and nonafluoroethoxybutane or hydrofluorocarbons such as decafluoropentane. Hydrofluoroethers are relatively low in toxicity, are claimed to have zero ozone depletion potential, have relatively short atmospheric lifetimes, and can have very low global warming potentials relative to chloro fluorocarbons and many chloro fluorocarbon substitutes. Furthermore, HFEs are listed as non-volatile organic compounds by the EPA, and as such are not considered as smog precursors.

One of the main differences between a conventional aqueous washing process and a non-aqueous solvent based washing process is that the solvent has to be regenerated within the machine for reasons of costs, environment and convenience. The waste stream from a solvent based wash cycle has a complex composition and contains dissolved soils, particulate matter, detergent ingredients and water. To separate this broad spectrum of waste components from the solvent a number of efficient separation steps will be required. One of the most common separation steps used in commercial dry-cleaning operations is distillation or evaporation of the solvent which is very suitable to remove the majority of waste compounds. However, for in-home washing processes distillation has significant drawbacks due to safety requirements. An alternative separation method that would be capable to remove a broad spectrum of waste compounds is adsorption. The main drawback of this method is the generation of a significant amount of solid waste and the need for substantial consumer interaction which is not desired for reasons of safety and convenience. Another important constraint for a solvent reclamation system is that always sufficient cleaned solvent has to be present in the machine to start a new wash cycle. A slow reclamation rate could be compensated by a larger volume of solvent in the machine but this is not desired for reasons of costs and safety.

Considering the potential problems of industrial solvent cleaning systems if applied in the domestic environment, there is a need for a novel solvent reclamation method which gives a better rate of solvent reclamation whilst reducing the amount of waste, as compared with known processes. This problem is solved by the present invention which is aimed at providing a system for cleaning of solvent which is compatible with the conflicting requirements of process rate, required solvent quality, minimal consumer interaction, process safety and minimal environmental impact.

These and other aspects, features and advantages will become apparent to those of ordinary skill in the art from a reading of the following detailed description and the appended claims which present, by way of illustration, various exemplary modes contemplated for carrying out the invention. The invention is capable of other different aspects and objects all without departing from the invention. For the avoidance of doubt, any feature of one aspect of the present invention may be utilised in any other aspect of the invention. It is noted that the examples given in the description below are intended to clarify the invention and are not intended to limit the invention to those examples per se. Other than in the experimental examples, or where otherwise indicated, all numbers expressing quantities of ingredients or reaction conditions used herein are to be understood as modified in all instances by the term "about". Similarly, all percentages are weight/weight percentages of the total composition unless otherwise indicated. Numerical ranges expressed in the format "from x to y" are understood to include x and y. When for a specific feature multiple preferred ranges are described in the format "from x to y" it is understood that all ranges combining the different endpoints are also contemplated. Where the term "comprising" is used in the specification or claims, it is not intended to exclude any terms, steps or features not specifically recited. All temperatures are in degrees Celsius (°C.) unless otherwise specified. All measurements are in SI units unless otherwise specified. All documents cited are in relevant part, incorporated herein by reference.

DEFINITION OF THE INVENTION

A first aspect of the present invention provides a solvent cleaning process of cleaning a non-aqueous solvent for use in a dry cleaning process for fabrics, the dry cleaning process comprising consecutive wash cycles for washing respective fabrics batches, the solvent cleaning process comprising:

(a) a basic solvent refining cycle; and (b) a first advanced solvent refining cycle;

said basic solvent refining cycle comprising a step of separating solvent into:

(i) a first solvent fraction; and (ii) a second solvent fraction which is less clean than the first fraction;

wherein the basic and first advanced solvent refining cycles are independently effected when solvent to be cleaned fulfils a respective predetermined condition.

A second aspect of the present invention provides a solvent cleaning unit for a non-aqueous solvent dry cleaning apparatus, the unit comprising (a) basic solvent refining means; and (b) first advanced solvent refining means;

said basic solvent refining cycle means comprising means for separating solvent into:

(i) a first solvent fraction; and (ii) a second solvent fraction;

the unit further comprising control means for independently causing the basic and first advanced solvent refining cycles to be effected when solvent to be cleaned fulfils a respective predetermined condition.

DETAILED DESCRIPTION OF THE INVENTION

Definitions

The term "dry cleaning process" used herein is intended to mean any process wherein laundry articles are contacted with a composition comprising dry cleaning solvent within a closable vessel. However, as used herein this term does not include any process comprising steps wherein the laundry articles are also immersed and rinsed in an aqueous cleaning composition comprising more than 80 wt. % water because this would damage garments that can only be dry cleaned.

The term "dry cleaning composition" as used herein is intended to mean the composition used in the dry cleaning process including the dry cleaning solvent, any surfactant, additives but excluding the laundry articles that are to be cleaned.

The term "rinse composition" as used herein is intended to mean the composition used in the dry cleaning process to rinse out the soil and excess of any surfactant, additives of a previous cleaning step The rinse composition does not include the laundry articles.

The term "dry cleaning solvent" as used herein is intended to mean any non-aqueous organic solvent that preferably has a liquid phase at 20° C. and standard pressure. The term organic has its usual meaning, i.e., a compound with at least one carbon hydrogen bond.

When referring to the "weight of the cloth", it is intended to mean the weight of the cloth of the laundry article after the cloth has been equilibrated at 20° C., a relative humidity of 55% and standard pressure.

The term "laundry articles" as used herein is typically a garment but may include any textile article. Textile articles include—but are not limited to—those made from natural fibres such as cotton, wool, linen, hemp, silk and man made fibres such as nylon, viscose, acetate, polyester, polyamide, polypropylene elastomer, natural or synthetic leather, natural or synthetic fur and mixtures thereof. Although the term is used in plural form it is intended to encompass the singular.

As used herein, references to solvent cleaning, solvent reclamation and solvent refining are to be taken as synonymous.

The term "solvent quality" as used herein is intended to mean a criterion for any solvent composition However, "unacceptable" solvent quality means that the solvent fulfils a predetermined condition as described further hereinbelow, which may be a parameter of the solvent itself or another condition such as a time related condition (i.e. a time after which, the solvent quality is deemed as being too low).

The term "liquid to cloth ratio" (w/w) (LCR) as used herein is intended to mean the ratio of the weight of the total amount of dry cleaning or rinse composition to the weight of the cloth as defined above.

The term "cleaning effective amount" as defined herein is intended to mean an amount effective to obtain the desired cleaning.

The water content refers to water purposefully added to the laundry articles, for example as part of the dry cleaning composition as such or a pre-treatment composition, including hydrated water as part of ingredients making up these compositions. It is not intended to include the moisture of the untreated wash load e.g., a wet towel.

Fundamentals of the Solvent Cleaning Process

The cleaning of the solvent comprises two basic elements. One is a basic solvent refining cycle. The other is an advanced solvent refining cycle. An additional advanced solvent refining cycle is preferably also utilised as described in more detail hereinbelow.

The basic and advanced cleaning cycles (and the optional further advanced cleaning cycle) do not have to be utilised after each wash cycle but only when the solvent (or portion of the total solvent) to be cleaned, fulfils a predetermined condition. That condition may for example be any of solvent colour, chemical composition of the solvent (such as water content and/or surfactant content) solids content of the solvent, solvent turbidity, dielectric constant of the solvent, solvent viscosity or solvent odour. The "predetermined condition for the solvent" may also be merely the elapsing of a predetermined number of wash cycles, preferably a predetermined plurality of wash cycles and which may be determined automatically or determined by the user who would then manually switch-on the appropriate cleaning cycle.

The basic solvent refining cycle separates solvent into relatively clean (first) and relatively dirty (second) fractions. Preferably, it comprises a filtration step and most preferably is effected by use of a microfiltration membrane system, most preferably a cross-flow microfiltration membrane system. The filtration separates the solvent from the last previous wash cycle into a first filtered fraction which is directly recycled for use in the next wash cycle The other is a second residue fraction which is subjected to the advanced solvent refining cycle.

The basic solvent refining cycle is intended to remove those components which have a lower solubility at a low temperature, compared with their solubility at an ambient temperature. Also, components which are insoluble are thereby removed, provided that they have a particle size greater than the average pore size of the filtration membrane.

The two main design parameters for a cross flow membrane are the total solvent flux (TF) through the membrane (permeate) in liters of solvent per hour and the membrane pore size. For the present system the TF preferably is larger than 10 $Lh^{-1}$, more preferably larger than 25 $Lh^{-1}$ and most preferred larger than 40 $Lh^{-1}$. A closely related parameter is the so-called trans membrane pressure (TMP) which is an important driver for the total flux through the membrane. The TMP should be larger than 0.5 bar and preferably be larger than 2 bar but lower than 10 bar. The total membrane surface area should be kept as low as possible for reasons of cost and space constraints and hence the specific solvent flux of the membrane should preferably be greater than 20 $Lh^{-1}m^{-2}bar^{-1}$ (liters of solvent per hour per square meter of membrane surface area per bar TMP), more preferably greater than 100 $Lh^{-1}m^{-2}bar^{-1}$ and still more preferably greater than 200 $Lh^{-1}m^{-2}bar^{-1}$ and most preferably greater than 1,000 $Lh^{-1}m^{-2}bar^{-1}$.

The pore size of the cross-flow membrane largely determines the separation ability of the membrane. However, for a given type of membrane a smaller pore size generally also decreases the specific solvent flux. In the present system the pore size should be chosen such that particulates and small droplets can be separated from the solvent while maximizing the total solvent flow through the membrane. Hence the pore size preferably should be smaller than 2 microns, more preferably smaller than 1 microns and most preferred be smaller than 0.2 microns but larger than 0.02 microns.

Other characteristics of a preferred cross-flow membrane may be defined by its channel diameter which preferably should be larger than 1 mm, more preferably larger than 2 mm and most preferred be larger than 5 mm but smaller than 25 mm. The channel diameter together with the number of channels in the cross flow membrane define in the total cross-sectional area of the membrane and hence the flow velocities in the channels. The velocity in the channels should preferably be larger than 0.5 m $s^{-1}$ to improve the flux through the membrane and decrease the risk of plugging or fouling, more preferably larger than 1 m $s^{-1}$ and most preferred larger than 2 m $s^{-1}$.

Before solvent is directed to the part of the apparatus for conducting the basic refining cycle, preferably it is prefiltered with a lint/button filter Preferably also, a sanitization module is utilised, for example on the outlet of the lint/button filter.

In the basic refining cycle, the solvent is preferably cooled down with an in-line cooler until the desired temperature (eg around −10° C.) is reached and after that, the solvent is filtered in the microfiltration membrane module.

Permeate is, depending on the quality of cleaning achieved, processed further in the advanced refining step, or respectively, pumped back into the reservoir for the next wash cycle. The retentate may be processed as solid waste after evaporation of any residual solvent.

In a typical system, the average volume ratio over many cycles of the first fraction to the second fraction is from 1:1 to 99:1, preferably from 7:3 to 99:1 and most preferably from 9:1 to 99:1.

When the second (relatively dirty) fraction fulfils a predetermined condition, as described above, it is subjected to advanced cleaning in the first advanced cleaning cycle.

The first advanced refining cycle removes those components which have high solubility, even at relatively low temperatures. These cannot be removed during the basic refining cycle and would build-up in the system. That is because they do not become insoluble at the lower temperatures of the basic refining cycle.

The first advanced refining cycle preferably is effected using an evaporation system, for example using a temperature of from 16° C. to 30° C. below the flash point of the solvent. If the solvent has no flash point then the temperature is less critical. Preferably also, it utilises replenishable means which is replaced when its cleaning ability becomes exhausted. In the case of an evaporation system, this may be a soil tray or soil filter. The first advanced temperature refining cycle could, in the alternative, utilise a solid absorption medium.

It is also preferred that whenever the relatively clean (first) fraction from the basic refining cycle has too low a solvent quality (as determined by a predetermined condition) then it is subjected to a second advanced refining cycle. This could be effected using the same apparatus as the first advanced refining cycle but preferably uses its own separate apparatus which preferably utilises a solid absorption medium. The medium preferably has a relatively high specific area and high absorption capability, preferably at least 0.2 g absorbate per g of absorbent material.

Suitable solid absorbent materials include activated carbons such as those disclosed in WO-A-03/093563. These include Acticarbone BGX, available from Atofina Chemicals, Inc Philadelphia, Pa.; Norit) GF-45 and Norit C, available from Norit America, Inc. Atlanta, Ga. Activated Adsorption Internal Surface Average Pore Cumulative Carbons Capacity (ma Area (m2/gram) Diameter Surface Area contaminants/ (Angstrom) (m2/gram) gram adsorbent) Acticarbone 424 1661 37.4 1407.3 BGX Florid GF-45 464 1742 230.9 946.6 NoritC 384 1351 38.1 769.7 The internal surface area and cumulative surface area can be determined by the well known BET method that measures nitrogen adsorption at 77° K. The cumulative pore volume and average pore diameter can be determined by the BJH method that measures nitrogen adsorption at 77° K. under BJH mesopore volume/size distribution. These methods are disclosed in more details by Brunauer et al., in J. Am. Chem. Soc., Vol. 60, 309 (1938); and Barrett et al. in J. Am. Chem. Soc., Vol. 73, 373 (1951). The BET and BJH measurements can be conducted with an Accelerated Surface Area and Porosity (ASAP) instrument, Model 2405, available from Micromeritics Instrument Corporation, Norcross, Ga.

The activated carbon may be fine powders having average particle sizes in the range of about 0.1-300 microns, preferably 0.1-200 microns. The average particle size can be measured by ISO 9001 EN-NS 45001 sieve analysis (using U.S. Standard Testing Sieves) or ASTM D4438-85. The activated carbon may be modified by steam treatment, acid treatment and/or base treatment. In a preferred embodiment, the activated carbon is acid-treated activated carbon.

The activated carbon may be coconut shell-based, wood-based and/or coal-based.

Additionally or alternatively to activated carbons, the solid absorbent material may comprise one or more of charged agents, polar agents, apolar agents, hydrogel-forming absorbent polymers, capillary sorption materials, high surface area fibers and so-called "spacer materials".

Other suitable solid absorbent materials also include those disclosed in WO-A-03/093563. Those include polar agents, apolar agents, charged agents, and mixtures thereof. The adsorbent material may comprise (a) charged agents and (b) polar and apolar agents that are commingled together. For example, the polar agents can be in the form of discrete particles and the apolar agents can be in the form of a fibrous structure, wherein the discrete particles of the polar agents are embedded, coated on, impregnated in, or bound to a fibrous substrate, such as a non-woven fibrous web.

One form of polar agent comprises one of formula: (YaOb) (wherein Y is Si, Al, Ti, P), a is an integer from about 1 to about 5: b is an integer from about 1 to about 10; and X is a metal.

Another suitable polar agent may be selected from the group consisting of: silica, diatomaceous earth, aluminosilicates, polyamide resin, alumina, zeolites and mixtures thereof. Preferably, the polar agent is silica, more specifically silica gel. Suitable polar agents include SILFAM silica gel, available from Nippon Chemical Industries Co., Tokyo, Japan; and Davisil 646 silica gel, available from W. R. Grace, Columbia, Md.

A further suitable polar agent is one having an average particle size of from about 0.5 Em to about 500 μm.

The polar agent is capable of regeneration such that the polar agent can release any contaminant that it temporarily removes from the used cleaning solvent upon being exposed to an "environmental condition" such as a solvent, an acid, a base and/or a salt or their combination Polar agents that are capable of regeneration typically exhibit a pKa or pKb of from about 2 to about 8. Polar agents that are capable of regeneration can be reused for multi-cycle contaminant removal from cleaning solvents.

Suitable apolar agents may comprise one or more of the following: polystyrene, polyethylene, and/or divinyl benzene The apolar agent may be in the form of a fibrous structure, such as a woven or nonwoven web. Suitable apolar agents include Amberlite 16 and XAD-4, available from Rohm & Haas, Philadelphia, Pa.

Suitable charged agents include those selected from the group consisting of: anionic materials, cationic materials, zwitterionic materials and mixtures thereof.

Suitable hydrogel-forming absorbent polymers may comprise at least one hydrogel-forming absorbent polymer (also referred to as "absorbent gelling material" or "AGM").

Hydrogel-forming absorent polymers include a variety of water-insoluble, but water-swellable polymers capable of absorbing aqueous liquids.

Suitable absorbent gelling materials typically have a water absorbent capacity of at least about 50 grams of water, preferably at least about 80 grams of water, and more preferably at least about 100 grams of water, per gram of AGM. The water absorbent capacity test is disclosed in U.S. Pat. No. 5,741,581.

Hydrogel-forming absorbent polymers are also commonly referred to as "hydrocolloids" and can include polysaccharides such as carboxymethyl starch, carboxymethyl cellulose, and hydroxypropyl cellulose; nonionic types such as polyvinyl alcohol, and polyvinyl ethers; cationic types such as polyvinyl pyridine, polyvinyl morpholinione, and N,N-dimethylaminoethyl or N,N-diethylaminopropyl acrylates and methacrylates, and the respective quaternary salts thereof.

Other gelling materials are also suitable as a solid absorbent material.

Examples of such gels may be based on acrylamides, acrylates, acrylonitriles, diallylammonium chloride, dialkylammonium chloride, and other monomers. Some suitable gels are disclosed in U.S. Pat. No. 4,555,344, U.S. Pat. No. 4,828,710, and EP-A-648,521.

The solid absorbent material may also comprise capillary sorption materials, such as a high surface area material. It is recognized that high surface area materials provide one or both of the following functions: i) a capillary pathway of liquid to enter and permeate the osmotic absorbents, and ii) additional absorbent capacity, via capillary action, of the osmotic absorbents. Thus, high surface area materials generally provide the suction capability within the separation apparatus or vessel used in the present invention, leading to an improved overall absorbency (i.e., higher absorbent capacity and quicker liquid uptake).

The high surface area materials may be "high surface area fibers", which form a fibrous web or a fibrous matrix. The high surface area material may also comprise an open-celled, hydrophilic polymeric foam.

High surface area fibers include those that are naturally occurring (modified or unmodified), as well as synthetic fibers. The high surface area fibers have surface areas much greater than fibers typically used in absorbent articles, such as wood pulp fibers. High surface area fibers include glass micrometers such as, for example, glass wool available from Evanite Fiber Corp. (Corvallis, Oreg.). Another type of high surface area fibers comprises fibrillated cellulose acetate fibers (otherwise known as "fibrets") have high surface areas relative to cellulose-derived fibers commonly employed in the absorbent article art. Representative fibrets are available from Hoechst Celanese Corp. (Charlotte, N.C.) as cellulose acetate Fibrets. A detailed discussion of fibrets, including their physical properties and methods for their preparation, is given in "Cellulose Acetate Fibrets: A Fibrillated Pulp With High Surface Area", Smith, J. E., Tappi Journal, December 1988, p. 237, and U.S. Pat. No. 5,486,410.

Representative fibers that may be modified to achieve high surface areas are disclosed in U.S. Pat. No. 5,599,335.

Suitable spacer materials include any fibrous or particulate material that is, at most, only slightly soluble in water and/or cleaning solvent. The spacer can be dispersed throughout a matrix of absorbent material in order to improve its permeability above that of a matrix made up of an absorbent material alone; or, the spacer can be used to maintain permeability even after the absorbent material swells and/or gels upon exposure to water. Therefore, the spacer helps reduce the pressure drop across an absorbent material matrix when a water-bearing fluid is passed through the matrix. In addition, if the absorbent material is prone to congealing after exposure to water and subsequent collapse, the spacer can aid in the reduction or prevention of gel congealing and collapse.

Examples of suitable spacer materials include sand, silica, aluminosilicates, glass microspheres, clay, layered silicates, wood, natural textile materials, synthetic textile materials, alumina, aluminum oxide, aluminum silicate, zinc oxide, molecular sieves, zeolites, activated carbon, diatomaceous earth, hydrated silica, mica, microcrystalline cellulose, montmorillonite, peach pit powder, pecan shell powder, talc, tin oxide, titanium dioxide, walnut shell powder, and particles of different metals or metal alloys. Also useful are particles made from mixed polymers (e.g., copolymers, terpolymers, etc.), such as polyethylene/polypropylene copolymer, polyethylene/propylene/isobutylene copolymer, polyethylene/styrene copolymer, and the like. Other absorbent particulate materials which can be used are the synthetic polymeric particles selected from the group consisting of polybutylene, polyethylene, polyisobutylene, polymethylstyrene, polypropylene, polystyrene, polyurethane, nylon, teflon, and mixtures thereof. Of these, the most preferred are polyethylene and polypropylene particles, with the oxidized versions of these materials being especially preferred Examples of commercially available particles include the Acumist micronized polyethylene waxes available from Allied Signal (Morristown, N.J.) available as the A, B. C, and D series in a variety of average particle sizes ranging from 5 microns to 60 microns. Particular examples are Acumist A-25, A-30, and A-45 oxidized polyethylene particles having a means particle size of 25, 30, and 45 microns, respectively. Examples of commercially available polypropylene particles include the Propyltex series available from Micro Powders, Inc. (Tarrytown, N.Y.) and Acuscrub 51, available from Allied Signal (Morristown, N.J.) having a mean particle size of about 125 microns.

After absorption has taken place, or if the absorption material is saturated, the absorption material is dried and disposed of via a solid waste disposal system. Typically, this is effected after several advanced solvent refining cycles.

The basic solvent refining cycle (first filtrate) is also subjected to advanced cleaning, either after a predetermined number of wash cycles or more preferably, when it fulfils a predetermined condition. Typical predetermined conditions are reaching a predetermined level of turbidity having a predetermined refractive index, or a predetermined dielectric constant. Examples of suitable transducers for effecting this measurement are described in more detail hereinbelow.

Waste disposable of the solid absorbent medium may typically involve physical removal of a container of the medium (effectively a cartridge) and replacement with a fresh cartridge.

Other Solvent Cleaning Cycle Techniques

Apart from microfiltration, evaporation and solid absorption, any basic or advanced cleaning cycle may employ any other solvent cleaning technique, provided that the technique for the basic solvent refinig cycle is one which separates solvent into at least two fractions, one cleaner than the other(s).

Some alternative processes include but are not limited to extraction, gravity separation, dialysis, electrodialysis, diafiltration, filtration, pervaporation, crystallisation, centrifugation, sedimentation, air stripping, desiccant drying, chemical addition, enzymatic, microbial, or bacterial addition, temperature modification, electrostatic coalescence and combinations thereof.

Extraction is the selective transfer of a compound or compounds from one liquid to another immiscible liquid or from a solid to a liquid. The former process is called a liquid-liquid extraction and is an indirect separation technique because two components are not separated directly. A foreign substance, an immiscible liquid is introduced to provide a second phase.

"Decantation" and "density gradation" are gravity-type separation methods. A "decanter" is defined as a vessel used to separate a stream continuously into two liquid phases using the force of gravity. Using Stokes' law, one can derive the settling velocity of the droplets in the continuous phase and design a decanter accordingly.

Dialysis is the transfer of solute through a membrane as a result of a transmembrane gradient in the concentration of the solute. It is accompanied by osmosis, which is a transfer of a solvent through a membrane as a result of a transmembrane gradient in the concentration of the solvent. The direction of a solute transfer in dialysis is opposite that of solvent transfer in osmosis. Dialysis is effective in the removal of low molecular weight solute molecules or ions from a solution via their passage through a semi-permeable membrane driven by a concentration gradient.

Electrodialysis is a process whereby the electrolytes are transferred through a system of solutions and membranes by an electrical driving force. As currently used, the term electrodialysis refers to a multiple-compartment electrodialysis with ion-exchange membranes. There are four variations of electrodialysis: electrolytic, concentration diluting, ion substitution, and reversal.

Diafiltration differs from conventional dialysis in that the rate of micro species removal is not dependent on concentration but is simply a function of the ultrafiltration rate (membrane area) relative to the volume to be exchanged or dialysed. Repeated or continuous addition of fresh solvent flushes out or exchanges salts and other micro species efficiently and rapidly.

Filtration is the separation of a matter/fluid mixture involving passage of most of the fluid through a porous barrier which retains most of the dissolved and/or dispersed matter contained in the mixture.

Solids can be designed to adsorb water while rejecting solvents. Likewise, membranes can be designed to pass water and retain solvents or vice versa. The use of pervaporation for removing water from solvent-water mixtures involves the use of a hydrophilic membrane. The removal of solvents from water is identical except for the use of a membrane that rejects water but is lipophilic.

Crystallisation is the process of producing crystals from a vapour, a melt, or a solution and is distinguished from precipitation in that the latter usually exhibits extremely high levels of super-saturation, primary nucleation, and low solubility ratios.

Centrifugation is a technique that separates materials based upon differences in density, the rate of separation being amplified by applying increasing rotational force. The force is called a centrifugal force and the apparatus providing the rotational force is called a centrifuge.

Sedimentation is the separation of suspended solid particles from a liquid stream via gravitational settling. Sedimentation can also be used to separate solid particles based on differences in their settling rates.

Air stripping is a method whereby many organic solvents can be removed from wastewater to a level at which the water can be discharged This method applies particularly to solvents that have a low solubility in water or a high volatility relative to water.

Desiccant drying involves bringing a water-wet solvent into contact with a solid, usually an electrolyte, suited to withdraw the water and form a second phase. Water can then be removed from this second phase by other means (e.g. decantation).

Chemical addition involves the addition of chemicals to change at least one physico-chemical property of the liquid such as pH, ionic strength, etceteras. Examples of these chemicals include salts, acids, bases, coagulants, and flocculants.

Enzymatic, microbial, or bacterial addition involves the addition of enzymes, microbes, or bacteria to a waste stream to remove organic contaminants from the stream.

Temperature modification enhances the separation of mixtures and can include both cooling and/or heating of the mixture. Increasing the temperature of the mixtures aids coalescence while cooling aids the crystallisation or freezing of one of the components.

Electrostatic coalescence involves exposing an emulsion containing two mutually insoluble phases (for example lipophilic fluid and water), wherein one phase is the continuous phase and the other is the discontinuous phase, to an electric field to affect coalescence of the discontinuous phase into droplets of a large enough size such that the droplets gravitate from the emulsion based on the density difference of the two phases. In order to carry this method out, the two phases must have at least a minor difference in dielectric constants and densities. Electric coalescence is a well-known process and is described in U.S. Pat. No. 3,207,686 to Jarvis et al.; U.S. Pat. No. 3,342,720 to Turner; U.S. Pat. No. 3,772,180 to Prestridge; U.S. Pat. No. 3,939,395 to Prestridge; U.S. Pat. No. 4,056,451 to Hodgson; U.S. Pat. No. 4,126,537 to Prestridge; U.S. Pat. No. 4,308,127 to Prestridge; and U.S. Pat. No. 5,861,089 to Gatti et al.

The Dry Cleaning Process

The dry cleaning process as a whole, may comprise one or more cleaning steps followed by one or more rinse steps. During a cleaning step the laundry articles are contacted with a dry cleaning composition. The dry cleaning composition typically comprises cleaning effective amounts of surfactants and often additives. During a rinse step, the laundry articles are contacted with a rinse composition. The rinse step is typically used to rinse off any unwanted excess of e.g. surfactant and/or cleaning agent. Typically more than one rinse step is used, for example 2, 3 or 4 steps. The rinse composition usually consists essentially of low grade dry cleaning solvent. The rinse composition, in particular the final rinse composition, may however comprise additives that are useful in rinse steps such as, but not limited to, antibacterial agents, colorants, perfumes, pro-perfumes, finishing aids, composition malodour control agents, odour neutralisers, anti-tarnishing agents, anti-microbial agents, anti-oxidants, anti-redeposition agents, thickeners, abrasives, divalent or trivalent ions, metal ion salts, fabric softening agents, optical brighteners, hydrotropes, suds or foam suppressors, suds or foam boosters, anti-static agents, dye fixatives, dye abrasion inhibitors, anti-crocking agents, wrinkle reduction agents, wrinkle resistance agents, soil repellency agents, sunscreen agents, anti-fade agents, and mixtures thereof.

Usually, the rinse composition—including any soil and other unwanted residues—will be separated from the laundry articles after each rinse step. The separation may be carried out in several ways. Spinning, twisting, wringing, squeezing the laundry articles are well known mechanical ways. Thus according to one preferred embodiment, a dry cleaning process is provided whereby each rinse step is followed by separating the rinse composition from the textile article wherein the liquid to cloth ratio (w/w) after separation is less than 0.6, preferably less than 0.4, more preferably less than 0.2.

Following the separation step, the laundry articles may be dried in any conventional manner. For example, the laundry articles may be heated while being agitated in for example a drum or subjected to a low pressure to evaporate the dry cleaning solvent. It is preferred to dry the articles in a way such that the evaporated solvent can be captured.

One or more rinse steps may be used in the dry cleaning process. Although it is highly preferred that the rinse composition for each rinse step comprises low grade dry cleaning solvent, the rinse composition for one or more rinse steps may comprise clean dry cleaning solvent. When more than one rinse step is used it is preferred that at least the final rinse step comprises contacting the laundry articles with a rinse composition, said rinse composition comprising a low grade dry cleaning solvent.

Dry Cleaning Solvent

The dry cleaning solvent is usually a non-flammable, non-chlorine containing organic dry cleaning solvent. Although the term dry cleaning solvent is used in the singular, it should be noted that a mixture of solvents may also be used. Thus, the singular should be taken to encompass the plural, and vice versa. Because of the typical environmental problems associated with chlorine containing solvents, the solvent preferably does not contain Cl atoms. In addition, the solvent should not be flammable such as most petroleum or mineral spirits having typical flash points as low as 20° C. or even lower. The term non-flammable is intended to describe dry cleaning solvents with a flash point of at least 37.8° C., more preferably at least 45° C., most preferably at least 50° C. The limit of a flash point of at least 37.8° C. for non-flammable liquids is defined in NFPA 30, the Flammable and Combustible Liquids Code as issued by National Fire Protection Association, 1996 edition, Massachusetts USA. Preferred test methods for determining the flash point of solvents are the standard tests as described in NFPA30 2000 edition. One preferable class of solvents is a fluorinated organic dry cleaning solvent including hydrofluorocarbon (HFC) and hydrofluoroether (HFE). However even more preferred are non flammable non-halogenated solvents. For example other classes of suitable highly preferred solvents are siloxanes (see below). It should be noted that mixtures of different dry cleaning solvents may also be used.

The most desirable solvents are non-ozone depleting and a useful common definition for the ozone depleting potential is defined by the Environmental Protection Agency in the USA: the ozone depleting potential is the ratio of the impact on ozone of a chemical compared to the impact of a similar mass of CFC-11. Thus, the ODP of CFC-11 is defined to be 1.0.

Hydrofluorocarbons

One preferred hydrofluorocarbon solvent is represented by the formula CxHyF(2x+2−y), wherein x is from 3 to 8, y is from 1 to 6, the mole ratio of F/H in the hydrofluorocarbon solvent is greater than 1.6.

Preferably, x is from 4 to 6 and most preferred x is 5 and y is 2.

Especially suitable are hydrofluorocarbon solvents selected from isomers of decafluoropentane and mixtures thereof. In particular useful is 1,1,1,2,2,3,4,5,5,5-decafluoropentane. The E.I. Du Pont De Nemours and Company markets this compound under the name Vertrel XF™.

Hydrofluoroethers

Hydrofluoroethers (HFES) suitable for use in the present invention are generally low polarity chemical compounds minimally containing carbon, fluorine, hydrogen, and catenary (that is, in-chain) oxygen atoms. HFEs can optionally contain additional catenary heteroatoms, such as nitrogen and sulphur. HFEs have molecular structures which can be linear, branched, or cyclic, or a combination thereof (such as alkylcycloaliphatic), and are preferably free of ethylenic unsaturation, having a total of about 4 to about 20 carbon atoms. Such HFEs are known and are readily available, either as essentially pure compounds or as mixtures.

Preferred hydrofluoroethers can have a boiling point in the range from about 40° C. to about 275° C., preferably from about 50° C. to about 200° C., even more preferably from about 50° C. to about 121° C. It is very desirable that the hydrofluoroether has no flashpoint. In general, when a HFE has a flash point, decreasing the F/H ratio or decreasing the number of carbon-carbon bonds each decreases the flash point of the HFE (see WO/00 26206).

Useful hydrofluoroethers include two varieties: segregated hydrofluoroethers and omega-hydrofluoroalkylethers. Structurally, the segregated hydrofluoroethers comprise at least one mono-, di-, or trialkoxy-substituted perfluoroalkane, perfluorocycloalkane, perfluorocycloalkyl-containing perfluoroalkane, or perfluorocycloalkylene-containing perfluoroalkane compound.

HFEs suitable for use in the processes of the invention include the following compounds:

C4F9OC2F4H
HC3F6OC3F6H
HC3F6OCH3
C5F11OC2F4H
C6F13OCF2H
C6F13OC2F4OC2F4H
c-C6F11CF2OCF2H
C3F7OCH2F
HCF2O(C2F4O)n(CF2O)mCF2H, wherein m=0 to 2 and n=0 to 3
C3F7O[C(CF3)2CF2O]pCFHCF3, wherein p=0 to 5
C4F9OCF2C(CF3)2CF2H
HCF2CF2OCF2C(CF3)2CF2OC2F4H
C7F15OCFHCF3
C8F17OCF2O(CF2)5H
C8F17OC2F4OC2F4OC2F4OCF2H
C4F9OC2H5
C4F9OCH3
C8F17OCH3

Preferred HFEs are according to the formula $$C_nX_{2n+1}—O—C_mY_{2m+1}$$

Wherein X and Y are each independently F or H provided that at least one F is present. Preferably, X=F and Y=H;

n=2-15 and m=1-10, but preferably, n=3-8 and m=1-4, or more preferably n=4-6 and m=1-3.

Especially preferred is a HFE wherein n=4 and m=1 or 2 which is marketed under the name of HFE 7100™ and 7200™ respectively by the 3M corporation.

Mixtures of different organic dry cleaning solvents may also be used. For example, a suitable dry cleaning or rinse composition may comprise a mixture of HFEs together with a mixture of hydrocarbons and/or siloxanes.

When solvent compounds are mentioned, isomers thereof are also included. Thus, suitable HFEs include nonafluoromethoxybutane (C4F9OCH3) isomers such as 1,1,1,2,2,3,3,4,4-nonafluoro-4-methoxy-butane (CH3OCF2CF2CF2CF3), 1,1,1,2,3,3-hexafluoro-2-(trifluoromethyl)-3-methoxy-propane (CH3OCF2CF(CF3)2), 1,1,1,3,3,3-hexafluoro-2-methoxy-2-(trifluoromethyl)-propane (CH3OC(CF3)3), and 1,1,1,2,3, 3,4,4,4-nonafluoro-2-methoxy-butane (CH3OCF(CF3)CF2CF3), approximate isomer boiling point=60° C.; Also isomers of nonafluoroethoxybutane (C4F9OC2H5) such as 1,1,1,2,2,3,3,4,4-nonafluoro-4-ethoxybutane (CH3CH2OCF2CF2CF2CF3), 1,1,1,2,3,3-hexafluoro-2-(trifluoromethyl)-3-ethoxypropane (CH3CH2OCF2CF(CF3)2), 1,1,1,3,3,3-hexafluoro-2-ethoxy-2-(trifluoromethyl)-propane (CH3CH2OC(CF3)3), and 1,1,1,2,3,3,4,4,4-nonafluoro-2-ethoxybutane (CH3CH2OCF(CF3)CF2CF3) with approximate isomer boiling points of 73° C.

Siloxane Dry Cleaning Solvent

Some siloxane solvents may also be used advantageously in the present invention.

The siloxane may be linear, branched, cyclic, or a combination thereof. One preferred branched siloxane is tris (trimethylsiloxyl) silane. Also preferred are linear and cyclic oligo dimethylsiloxanes are preferred. One preferred class of siloxane solvents is an alkylsiloxane represented by the formula R3Si(—O—SiR2)w-R Where each R is independently chosen from an alkyl group having form 1 to 10 carbon atoms and w is an integer from 1 to 30. Preferably, R is methyl and w is 1-4 or even more preferably w is 3 or 4.

Of the cyclic siloxane octamethyl cyclotetrasiloxane and decamethyl cyclopentasiloxane are particularly effective.

Very useful siloxanes are selected from the group consisting of decamethyl tetrasiloxane, dodecamethyl pentasiloxane and mixtures thereof.

Preferably, the organic solvent is not a terpene. Especially suitable organic dry cleaning solvents include those selected from the group consisting of the isomers of nonafluoromethoxybutane, nonafluoroethoxybutane and decafluoropentane, octamethyl cyclotetrasiloxane, decamethyl cyclopentasiloxane, decamethyl tetrasiloxane, dodecamethyl pentasiloxane and mixtures thereof. Even more preferred are organic dry cleaning solvents include those selected from the group consisting of octamethyl cyclotetrasiloxane, decamethyl cyclopentasiloxane, decamethyl tetrasiloxane, dodecamethyl pentasiloxane and mixtures thereof.

The dry cleaning compositions of the invention generally contain greater than about 50 percent by weight of organic dry cleaning solvent, preferably greater than about 75 weight percent, more preferably greater than about 80 weight percent, more preferably greater than about 85 weight percent, even more preferably greater than about 95 weight percent, but preferably less than 100 weight percent of organic dry cleaning solvent by weight of the total dry cleaning composition. Such amounts aid in improved drying times and maintain a high flash point or no flash point at all.

Rinsing

A rinse composition may be used in a dry cleaning process as described below. The dry cleaning process may comprise different steps in any order depending on the desired outcome. The number and length of steps for e.g. cleaning, rinsing, conditioning steps may depend on the desired outcome. Each step may preferably last from at least 0.1 min, or preferably at least 0.5 min or more preferably at least 1 min or even 5 min, and at most 2 hrs, preferably at most 30 min, even more preferably at most 20 min and in some instances at most 5 min. In some cases longer times may be desired for example overnight.

Generally, articles such as clothing are cleaned by contacting a cleaning effective amount of the dry cleaning composition according to one aspect of the invention with the articles for an effective period of time to clean the articles or otherwise remove stains. Preferably, the laundry articles are immersed in the dry cleaning or rinse composition. The amount of dry cleaning or rinse composition used and the amount of time the composition contacts the article can vary based on equipment and the number of articles being cleaned. Normally, the dry cleaning process will comprise at least one step of contacting the article with a dry cleaning composition according to one aspect of the invention and at least one step of rinsing the article as described above. The rinse composition will usually comprise of mainly solvent but additives may be added as desired.

Typically, each step comprises contacting the laundry articles with a composition tailored for that step, e.g. a dry cleaning composition for a cleaning step, a rinsing composition for a rinsing step. The last rinsing step may also be used for conditioning when the composition comprises conditioning agents while it also rinses off any unwanted residues e.g. soil or surfactants. A step will normally comprise contacting the laundry articles with a composition, agitating the laundry articles in the composition, removing the composition from the laundry articles as mentioned previously.

The laundry articles in need of treatment are placed inside a closable vessel. It will be clear that the process is also suitable for cleaning one laundry article at the time although it will often be more efficient to clean more articles at the same time. Preferably, the vessel is a rotatable drum as part of an automated dry cleaning machine that is closed or sealed in such a way that the dry cleaning solvent can be contained within the machine if needed. Inside the vessel, the laundry articles are then contacted with the dry cleaning composition. This may be done in any way known in the art such as spraying or even using a mist.

In some cases it may be useful to formulate the composition for one of the steps in the dry cleaning process in situ In the drum by contacting the different ingredients of the composition separately with the laundry articles. For example—when the dry cleaning composition comprises dry cleaning solvent, water and surfactant—first water, then surfactant followed by the dry cleaning solvent. Or first the dry cleaning solvent, followed by the surfactant and then water. Or any other order.

Alternatively, two or more of the ingredients may be premixed before they are contacted with the laundry articles. For example, water and surfactant may be premixed and this premix is then contacted with the laundry followed by the dry cleaning solvent. In the alternate, dry cleaning solvent and surfactant may be premixed and this premix is then contacted with the laundry followed by water.

Thus, in one preferred aspect, in situ formulation of the dry cleaning composition may also be provided by incorporating one or more ingredients of the dry cleaning composition into a pretreatment composition, pretreating the laundry articles with the pre-treatment composition, contacting the laundry articles with the remaining ingredients of the dry cleaning composition thereby formulating the dry cleaning composition in situ. This pre-treatment may take place manually outside the drum or mechanically inside the drum as part of a pre-treatment step The pre-treatment step per se need not be immersive, i.e., it may be limited to treating the stained areas only provided that when the laundry articles are contacted with all the ingredients making up the final dry cleaning composition, the laundry articles are immersed in said dry cleaning composition. For example—when the dry cleaning composition comprises of dry cleaning solvent, water and surfactant—stained areas of the laundry articles may be pretreated with a premix of water and surfactant manually or by an automated process. After effective pre-treatment time is allowed, the laundry articles may be contacted in the drum with the remaining ingredients such as in this case, the dry cleaning solvent (and optionally the remaining amounts of water and cleaning agent) to result in situ in the dry cleaning composition according to this aspect of the invention. The pre-treatment time will be at least 5 sec but could be less than 1 day, preferably less than 1 hr, more preferably less than 30 min. The pre-treatment composition may be formulated to treat specific stains. For example cleaning effective amounts of protease and other enzymes may be included to treat proteinacious stains.

In another preferred embodiment, the complete dry cleaning composition is premixed in a separate premix compartment. For example, when the dry cleaning composition comprises dry cleaning solvent, surfactant and water, these may be premixed in a separate compartment before the dry cleaning composition is contacted with the laundry articles. Preferably such a premix is in the form of an emulsion or microemulsion.

Forming a premix of for example a water-in-oil emulsion can be brought about by any number of suitable procedures. For example, the aqueous phase containing a cleaning effective amount of surfactant package can be contacted with the solvent phase by metered injection just prior to a suitable mixing device. Metering is preferably maintained such that the desired solvent/water ratio remains relatively constant. Mixing devices such as pump assemblies or in-line static mixers, a centrifugal pump or other type of pump, a colloid mill or other type of mill, a rotary mixer, an ultrasonic mixer and other means of dispersing one liquid in another, nonmiscible liquid can be used to provide effective agitation to cause emulsification.

These static mixers are devices through which the emulsion is passed at high speed and in which said emulsion experiences sudden changes in direction and/or in the diameter of the channels which make up the interior of the mixers. This results in a pressure loss, which is a factor in obtaining a correct emulsion in terms of droplet size and stability.

In one variant of the method of the invention, the mixing steps are for example sequential. The procedure consists in mixing the solvent and emulsifier in a first stage, the premix being mixed and emulsified with the water in a second stage.

In another variant of the method of the invention, provision is made for carrying out the above steps in a continuous mode.

The premix may take place at room temperature, which is also the temperature of the fluids and raw materials used.

A batch process such as an overhead mixer or a continuous process such as a two fluid co-extrusion nozzle, an in-line injector, an in-line mixer or an in-line screen can be used to make the emulsion. The size of the emulsion composition in the final composition can be manipulated by changing the mixing speed, mixing time, the mixing device and the viscosity of the aqueous solution. In general, by reducing th mixing speed, decreasing the mixing time, lowering the viscosity of the aqueous solution or using a mixing device that produces less shear force during mixing, one can produce an emulsion of a larger droplet size. Especially preferred are ultrasonic mixers. Although the description above refers to the addition of surfactant it is understood it may also apply to the addition of additives to e.g. the rinse composition.

While the laundry articles are in contact with the dry cleaning solvent, it is preferred to add mechanical energy for example by agitating or tumbling the laundry articles by rotating the drum or other means known in the art. Usually after one step, the dry cleaning solvent including any additives and/or loosened soil will be separated from the laundry articles as described above.

In other instances it may be advantageous to recirculate at least part of the dry cleaning composition during one step. For example by separating a portion of the dry cleaning composition from the laundry articles, optionally filtering soil from the separated portion of dry cleaning composition and contacting the laundry articles with the filtered portion of the dry cleaning composition.

The surfactants, dry cleaning solvents, cosolvents and optional additives used in present invention are described below and may be the same or different for each step of the inventive process.

The dry cleaning is usually performed at atmospheric pressure and room temperature, between 10 and 30° C. in most countries. In some instances the process temperature may be elevated to just under the boiling point of the most volatile dry cleaning solvent used. Preferably, the at least one rinse step is carried out between 0 and 70° C. Sometimes the process may be performed under reduced or elevated pressure, typically achieved via a vacuum pump or by supplying a gas, such as nitrogen, to the apparatus thereby increasing the pressure the closable vessel. The dry cleaning process may be carried out in any suitable apparatus. Preferably, the apparatus will comprise a closable vessel and means to recycle the dry cleaning solvents used to minimise solvent losses into the environment. Th dry cleaning composition may be in the form of a micro-emulsion but usually will be in the form of a macro-emulsion, which is generally accepted to be thermodynamically unstable. A suitable process and appliance for dry cleaning is described in U.S. Pat. No. 6,045,588. The solvent will preferably be filtered and recycled in the same appliance. Generally, the laundry articles will be agitated in the dry cleaning process by tumbling, rotating, ultrasonics or any suitable type of mechanical energy (see U.S. Pat. No. 6,045,588).

Sometimes clothes do not need removing stains or soil but need only to be freshened up. Accordingly, in yet another preferred embodiment, the low grade dry cleaning solvent may be used in a dry cleaning process for freshening up laundry. In this embodiment the dry cleaning process does not comprise a dry cleaning step i.e., a cleaning step comprising amounts of surfactant and/or cleaning agent(s) that are so high that these need to be rinsed out in a subsequent rinsing step. Such a process may comprise at least one rinse step wherein the rinse composition for freshening up laundry comprises low grade dry cleaning solvent and optionally, but preferably, additives as described below. Preferably, the additives are selected from perfume, agent pro-perfumes, finishing aids, composition malodour control agents, odour neutralisers, polymeric dye transfer inhibiting agents, anti-tarnishing agents, anti-microbial agents, anti-oxidants, anti-redeposition agents, soil release polymers, electrolytes, pH modifiers, thickeners, fabric softening agents, optical brighteners, fabric softeners, anti-static agents, dye fixatives, dye abrasion inhibitors, anti-crocking agents, wrinkle reduction agents, wrinkle resistance agents, soil repellency agents, sunscreen agents, anti-fade agents, and mixtures thereof. The amount of additives is as described below and one or more rinse steps may be used with only dry cleaning solvent, preferably low grade dry cleaning solvent. Preferably the amounts are so low that no additional rinse steps are needed. Thus in the latter case the dry cleaning process for freshening up laundry comprises only one step of contacting the laundry articles with said rinse composition.

Water

In some cases water may be used in the dry cleaning steps and the amount of water is important. In those cases, the amount of water present in any step of the dry cleaning process is at such a level that laundry articles can be safely cleaned. This includes laundry articles that can only be dry cleaned. The amount of water present in a low aqueous dry cleaning composition is preferably from 0.01 to 50 wt. % water more preferably from 0.01 to 10 wt. %, even more preferably from 0.01 to 0.9 wt. % water by weight of the dry cleaning composition or more preferably, 0.05 to 0.8 wt. % or most preferable 0.1 to 0.7 wt. %. The amount of water present in a non-aqueous dry cleaning composition is preferably from 0 to 0.1 wt. % water by weight of the dry cleaning composition or more preferably, 0 to 0.01 wt. % or even more preferable 0 to 0.001 wt. % and most preferable 0 wt. %. When the dry cleaning composition comprises water, preferably the water to cloth ratio (w/w) (WCR) is less than 0.45, more preferably less than 0.35, more preferably less than 0.25, more preferably less than 0.2, most preferably less than 0.15, but usually more than 0.0001, preferably more than 0.001, more preferably more than 0.01.

When the dry cleaning process comprises more than one step, this WCR preferably applies to all steps in the dry cleaning process, especially when the dry cleaning composition comprises water and solvent. However, the WCR may or may not differ for each step. It is also preferred that this WCR applies to each step in the dry cleaning process wherein the LCR is more than 1.

Cosolvents

The compositions of the invention may contain one or more cosolvents. The purpose of a cosolvent in the dry cleaning compositions of the invention is often to increase the solvency of the dry cleaning composition for a variety of soils. However, if a cosolvent is used the dry cleaning composition is preferably a non-azeotrope as azeotropes may be less robust.

Useful cosolvents of the invention are soluble in the dry cleaning solvent or water, are compatible with typical additives, and can enhance the solubilisation of hydrophilic composite stains and oils typically found in stains on clothing, such as vegetable, mineral, or animal oils. Any cosolvent or mixtures of cosolvents meeting the above criteria may be used.

Useful cosolvents include alcohols, ethers, glycol ethers, alkanes, alkenes, linear and cyclic amides, perfluorinated tertiary amines, perfluoroethers, cycloalkanes, esters, ketones, aromatics, the fully or partly halogenated derivatives thereof and mixtures thereof. Preferably, the cosolvent is selected from the group consisting of alcohols, alkanes, alkenes, cycloalkanes, ethers, esters, cyclic amides, aromatics, ketones, the fully or partly halogenated derivatives thereof and mixtures thereof.

Representative examples of cosolvents which can be used in the dry cleaning compositions of the invention include methanol, ethanol, isopropanol, t-butyl alcohol, trifluoroethanol, pentafluoropropanol, hexafluoro-2-propanol, methyl t-butyl ether, methyl t-amyl ether, propylene glycol n-propyl ether, propylene glycol n-butyl ether, dipropylene glycol n-butyl ether, propylene glycol methyl ether, ethylene glycol monobutyl ether, trans-1,2-dichloroethylene, decalin, methyl decanoate, t-butyl acetate, ethyl acetate, glycol methyl ether acetate, ethyl lactate, diethyl phthalate, 2-butanone, N-alkyl pyrrolidone (such as N-methylpyrrolidone, N-ethyl pyrrolidone), methyl isobutyl ketone, naphthalene, toluene, trifluorotoluene, perfluorohexane, perfluoroheptane, perfluorooctane, perfluorotributylamine, perfluoro-2-butyl oxacyclopentane.

Preferably, the cosolvent is present in the compositions of the invention in an effective amount by weight to form a homogeneous composition with the other dry cleaning solvent(s) such as HFE. The effective amount of cosolvent will vary depending upon which cosolvent or cosolvent blends are used and the other dry cleaning solvent(s) used in the composition. However, the preferred maximum amount of any particular cosolvent present in a dry cleaning composition should be low enough to keep the dry cleaning composition non-flammable as defined above.

In general, cosolvent may be present in the compositions of the invention in an amount of from about 1 to 50 percent by weight, preferably from about 5 to about 40 percent by weight, and more preferably from about 10 to about 25 percent by weight. In some exceptional cases the cosolvent may be present amounts of from about 0.01 percent by weight of the total dry cleaning composition.

Surfactants

The dry cleaning compositions of the invention can utilise many types of cyclic, linear or branched surfactants known in the art, both fluorinated and non-fluorinated. Preferred solvent compatible surfactants include nonionic, anionic, cationic and zwitterionic surfactants having at least 4 carbon atoms, but preferably less than 200 carbon atoms or more preferably less than 90 carbon atoms. Preferred surfactants are described in pending application EP 02080470.4.

These and other surfactants suitable for use in combination with the organic dry cleaning solvent as adjuncts are well known in the art, being described in more detail in Kirk Othmer's Encyclopaedia of Chemical Technology, 3rd Ed., Vol. 22, pp. 360-379, "Surfactants and Detersive Systems", incorporated by reference herein. Further suitable nonionic detergent surfactants are generally disclosed in U.S. Pat. No. 3,929,678, Laughlin et al., issued Dec. 30, 1975, at column 13, line 14 through column 16, line 6, incorporated herein by reference. Other suitable detergent surfactants are generally disclosed in WO-A-0246517.

The surfactant or mixture of surfactants is present in a cleaning effective amount. A cleaning effective amount is the amount needed for the desired cleaning. This will, for example, depend on the number of articles, level of soiling and volume of dry cleaning composition used. However, surprisingly effective cleaning was observed when the surfactant was present from at least 0.001 wt % to 10 wt. % by weight of the dry cleaning composition. More preferably, the surfactant is present from 0.01 to 3 wt. % or even more preferably from 0.05 to 0.9 wt. % by weight of the dry cleaning composition. More preferably, the surfactant is present from 0.1 to 0.8 wt. % or even more preferably from 0.3 to 0.7 wt. % by weight of the dry cleaning composition.

Surprisingly, it was found that the surfactant to cloth ratio (w/w) (SCR) was important in many cases to obtain an effective cleaning while maintaining a good garment care. Preferably, the SCR is at most 0.25, more preferably at most 0.12, more preferably at most 0.08, more preferably at most 0.04, but preferably at least 0.0001, more preferably at least 0.0003, more preferably at least 0.001 and most preferably at least 0.002.

Optional Additives

Compositions for use in a process according to the invention may contain one or more optional additives. Additives include any agent suitable for enhancing the cleaning, appearance, condition and/or garment care. Generally, the cleaning agent may be present in the compositions of the invention in an effective amount or preferably of about 0 to 20 wt. %, preferably 0.001 wt. % to 10 wt. %, more preferably 0.01 wt. % to 2 wt. % by weight of the total composition.

Some suitable additives include, but are not limited to, builders, enzymes, bleach activators, bleach catalysts, bleach boosters, bleaches, alkalinity sources, antibacterial agents, colorants, perfumes, pro-perfumes, finishing aids, lime soap dispersants, composition malodour control agents, odour neutralisers, polymeric dye transfer inhibiting agents, crystal growth inhibitors, photobleaches, heavy metal ion sequestrants, anti-tarnishing agents, anti-microbial agents, anti-oxidants, anti-redeposition agents, soil release polymers, electrolytes, pH modifiers, thickeners, abrasives, divalent or trivalent ions, metal ion salts, enzyme stabilisers, corrosion inhibitors, diamines or polyamines and/or their alkoxylates, suds stabilising polymers, process aids, fabric softening agents, optical brighteners, hydrotropes, suds or foam suppressors, suds or foam boosters, fabric softeners, anti-static agents, dye fixatives, dye abrasion inhibitors, anti-crocking agents, wrinkle reduction agents, wrinkle resistance agents, soil repellency agents, sunscreen agents, anti-fade agents, and mixtures thereof.

BRIEF DESCRIPTION OF THE DRAWING

A schematic diagram of an in-home dry cleaning process and apparatus which incorporates solvent cleaning according to the present invention.

DESCRIPTION OF PREFERRED EMBODIMENTS

In the description of the reclamation system and method various sensors to judge the solvent quality, the liquid level, the need for solid waste disposal or others are mentioned. It should be understood that these sensors may be based on measuring turbidity, conductivity, light transmittance, light extinction (by UV measurement), total flow or volume, by manual activation as desired or any other type of measurement that can be used to determine the concentration of dissolved or non-dissolved compounds in the solvent.

A sensor may also be understood as a routine, either in soft or hardware, used to control the reclamation system. However, by a sensor it is also meant that a certain event may be triggered from the activation by timed or counting, either in terms of real-time monitoring (occurring every hour, day, week, month, etc) or by the number of times the reclamation process or a particular step of said process has occurred.

The accompanying drawing shows a block diagram of the preferred embodiment of the solvent reclamation system according to the invention. Used solvent returned from the wash cycle is routed to used solvent vessel 1. First the used solvent passes over a so-called button trap 3, that will take out any large particulates, lint or other matter that is too large to be processed in the reclamation system. A sanitization module 4 is located between the button trap 3 and the used solvent vessel 1. The used solvent vessel 1 may include a solvent level sensor 5. The tank volume may be greater than the sum total volume of working solvent plus any additives used such that the entire solvent volume of the machine can be adequately stored in the used solvent vessel.

The used solvent vessel outlet is in fluid communication with a high pressure pump 7, which pumps the used solvent into a chiller 9 or directly into the clean solvent storage tank 11. The position of valve 13 depends on the quality of the solvent and which is determined by sensor 15 in the line between high pressure pump 7 and valve 13.

Between the chiller 9 and the multi-way valve 17 is a temperature sensor 18 is located The default position of the valve shunts the cooled used solvent back into the used solvent vessel. Thus, cooled used solvent in the vessel is returned to the used solvent vessel. The used solvent vessel may also include a temperature sensor to measure the temperature of its contents. When the desired temperature is achieved, for example, less than 0° C., a multi-way valve 17 may shunt the cooled used solvent into a cross flow membrane 19. A less than zero temperature is desirable as water will freeze and thus not permeate in the cross flow membrane. Depending on the quality of the solvent as determined by sensor 15, the option exists to shunt the solvent directly through valve 17 to cross-flow membrane 19 without cooling. This option is preferred when the level of dissolved impurities in the solvent is low (for example a rinse solvent) and only particulate soils have to be removed, hence saving energy and time.

The cross flow membrane 19 is mainly selected for its ability to filter out particulate matter such as fibers, sand, ice crystals and others from the solvent which passes the membrane as a permeate. Dissolved compounds will also pass the membrane. In addition the membrane 19 is selected for its ability to filter out other non-dissolved materials like fats, oils, surfactants and others which are in the form of droplets, micelles or other phases separated from the solvent. The membrane material may be polymer or ceramics based. Ceramic membranes generally offer high permeate fluxes, resistance to most solvents, and are relatively rigid structures, which permits easier cleaning. Polymer based membranes offer cost effectiveness and disposability. Polymer based membranes may comprise polysulfone, polyethersulfone, and/or methyl esters, or any mixture thereof.

The permeate flow exits the membrane 19 and enters a permeate pump 21. In the line between the cross-flow membrane 19 and the permeate pump 21 a sensor 23 is present that determines the quality of the solvent. If the quality of the solvent is acceptable, i.e. if the solvent contains a low amount of impurities, a valve 25 shunts the permeate flow from the cross-flow membrane 19 directly to clean solvent vessel 11. When the solvent quality is judged to be low (sensor 23), valve 25 directs the permeate into an adsorber column 27, filled with one or more materials with a high surface area such as activated carbon, zeolites, silicates or other high surface area materials. The adsorber column is selected for its ability to remove organic residues, such as odors, fatty acids, dyes, petroleum based products, surfactants or the like that are miscible enough with the bulk solvent to pass through the cross flow membrane 19.

The adsorber column 27 will have to be replaced when the adsorbing capacity of the adsorption material is exhausted. The state of the adsorber bed is monitored by sensor 29 which will activate an indicator of any type when the adsorber column with adsorption material has to be replaced by the consumer or a service person. The adsorption column is preferably replaced after more than 5 wash cycles, more preferably after more than 15 wash cycles and most preferably after more than 20 wash cycles.

The concentrated solvent exits the cross flow membrane 19 and is routed towards a multi-way valve 31. In the default position, the multi-way valve 31 shunts the concentrate to the used solvent vessel 1 and is mixed with the remaining used solvent in the vessel and is then routed back through the cross-flow filtration process described above. Once the concentrate multi-way valve 31 is activated, the concentrate is routed to a low temperature evaporation unit 33.

The decision to route the concentrate stream to the low temperature evaporation unit 33 is based on the combination of a poor solvent quality as determined by another sensor 35 and a desired volume reduction of the initial amount of used solvent in vessel. The later criterion is related to the limited volume of concentrate solvent that can be handled in the low temperature evaporation unit 33. The maximum capacity of handling concentrated solvent from valve 31 of the low temperature evaporation unit 33 preferably is smaller than 20 L, more preferably smaller than 15 L and most preferably smaller than may 10 L but larger than 2 L. Therefore the valve 31 is preferably connected to a flow measuring sensor 37 that only allows a certain amount of concentrate solvent into the low temperature evaporation unit 33. In addition the volume reduction of the used solvent in the cross-flow membrane circulation loop through pump 108 is preferably larger than 50%, more preferably larger than 70% and most preferably larger than 90% but smaller than 99%. The volume reduction is defined as the ratio between the initial volume in vessel 1 (V0) minus by the remaining volume in vessel 1 after a certain time (Vt) divided by V0 and multiplied by 100%.

$$\text{Volum reducti } n=(V0-Vt)/V0*100\%$$

This can also be expressed as a volume ratio rather than a percentage.

After the criterion of volume reduction is satisfied, also the criterion of an unacceptable solvent quality as judged by sensor 35 has to be satisfied before the concentrate flow is shunted towards the low temperature evaporation unit 33 through valve 31. Clearly, it would be only be useful to treat the concentrated solvent in the low temperature evaporation unit when the concentrated solvent contains a significant amount of impurities.

The preferred method to separate the remaining solvent from the concentrated solvent stream is low temperature evaporation. Low temperature evaporation is based on the circulation of air over a container holding a suspension of solvent with the waste compounds contained in it. Because of the safety restrictions the air may not have the temperature above 30° F. below the flash point of the applied solvent. This warm air is led over the surface of or bubble through the suspension of the concentrated solvent, allowing the air to saturate with solvent vapor. This saturated air is then led through a condenser (not shown) where the air is cooled and the vapor is separated from the air.

When the concentrate solvent is routed to the low temperature evaporation unit 33, the low temperature evaporation of the solvent may not be started. This will only take place if the utilization of the capacity of the low temperature evaporation unit is up to the desired level as is judged by a sensor 39. Hence the valve 31 may shunt concentrated solvent streams to the low temperature evaporation unit 33 for a number of times before the low temperature evaporation may be started which depends on the capacity of the low temperature evaporation unit and the volume of concentrated solvent that is being passed by sensor 37.

After the low temperature evaporation treatment is completed, sensor 39 determines if solid waste has to be removed from the low temperature evaporation unit. Sensor 39 will activate an indicator of any type when the solid waste has to be removed by the consumer. The adsorption column is preferably replaced after more than 10 wash cycles, more preferably after more than 25 wash cycles and most preferably after more than 50 wash cycles.

When the quality of the solvent as determined by sensor 15 is very low, the option exists to shunt the solvent directly through valve 13 and valve 41 to the adsorber column 27 without further processing. This option may be preferred when the soil level is very high or as an element of a thorough clean-up of the solvent that takes place every week, month, year of any other period.

From above it will be clear that by using the described novel reclamation method it is possible to optimize the reclamation process with respect to time required to regenerate the used solvent, consumption of adsorber material, generation of solid waste and user friendliness. From the dry cleaning process, basically two types of used solvent streams will have to be treated in the reclamation system. First is a used solvent stream as a result of a wash cycle in the dry cleaning process (wash stream), the other used solvent stream is the result of a rinse step in the dry cleaning process (rinse stream). It will be clear that a wash stream will generally contain a higher concentration of detergent components, dissolved soils, particulate matter and possibly water whereas a rinse stream will mainly contain particulate matter and a low amount of dissolved compounds. Hence, a preferred reclamation method, but not necessarily the only method, for a wash stream will therefore be a cooling step in chiller 9, followed by a cross-flow filtration step in cross flow membrane 19 until the desired volume reduction has been realized. Then the concentrated solvent stream will be shunt to the low temperature evaporation unit by valve 31. A preferred reclamation method, but not necessarily the only method, for a rinse stream will be a direct route to the clean solvent storage 11 through valve 13. Alternatively, based on sensor 15, valve 13 may shunt the rinse stream to the cross-flow membrane 19 without cooling in chiller 9 to remove particulate matter. After the desired volume reduction has been realized, the concentrated solvent stream will be collected in the used solvent vessel 1.

Sensors

Various sensors may be located along any path of the reclamation process. For example, temperature sensors may be associated with the used solvent vessel 1 to measure the temperature of the used solvent vessel contents; with the chiller 9 to monitor the temperature of the contents and to activate the chiller multi-way valve 17; with the clean tank 11 to monitor the temperature of the working solvent; with the coolant compressor-coil system to ensure that the chiller 9 operates efficiently; or anywhere else as desired.

Other sensors may include a single pressure sensor to monitor the pressure at a given point. For example, a single pressure sensor may be associated with the used solvent vessel 1 to ensure that pressure is adequately relieved via a pressure relief valve 43; with the clean tank 11; with the coolant compressor-coil system; with the high pressure pump 7 to ensure that the high pressure pump is operating at a high enough pressure; or as desired anywhere else. In addition, double paired pressure sensors in which one-half of the pair is located on either side of a component, may be used. This arrangement permits a pressure gradient measurement across the component. For example, the double pressure sensor system may be associated with the cross flow membrane 19 to measure if there is a questionable pressure drop across the membrane that may indicate that the membrane is becoming clogged; with the permeate filter 27 to measure a pressure drop that may indicate that the filter is becoming clogged; or anywhere else as desired. Additionally, the present sensors can be used to measure the levels in the tank and/or the drum.

Other sensors may include leak sensors in the pans to sense if leaking occurs, leak sensors to sense for solvent leaks, flow rate sensors or meters to measure the quantity of solvent or quantity of air that has moved past the flow meter point; a weight sensor to estimate the size of a load or the saturation of a load; sensors to indicate when the machine is deactivated so that the consumer may interact with it (e.g., ready to clean lint filter, clean condenser units, clean condenser radiator coils, ready to swap out cartridges, ready to load/unload fabrics, etc.)

Level detection is an important feature that may be used to determine if service needs to be scheduled, when the reclamation cycle is complete, potential leaking of the system, etc. Some potential methods to detect levels in the drum, storage tanks and condensing reservoirs are continuous and point level sensing. One method for continuous level sensing is through pressure, but these sensors need to be robust to the IWF and isolated from the system. Another continuous level sensor is ultrasonic and the material choices are PVDF, ceramic crystals, quartz cyrstals, electrostatic and MEMS. Shaped electromagnetic field (SEF), float sensing, laser deflection and petrotape/chemtape are other continuous level sensing techniques. Potential point level sensing techniques are capacitive, float sensing, conductivity and electric field imaging.

Turbidity is another important sensing feature useful in determining contamination level that could facilitate more detergent dispensing or another cycle through the reclamation system. Turbidity sensors can be placed in the storage tanks or the sump area of the wash system and can be accomplished via conductivity measurements, infrared technology and the combination of level sensor such as SEF and flow measurements.

Flow sensing can be used to determine the amount of solvent in the storage tanks, the drum, and the condenser as a possible means to terminate the drying cycle, the fullness of the filter beds, etc. This can be completed using turbines or positive displacement sensors.

Another useful sensor measurement is humidity for both water vapor and IWF detection. This can be utilized to help determine the presence of a leak, the termination of the drying cycle, if a dehydration step to remove water needs to be completed before an IWF wash. Some technologies that may be useful are non-dispersive infrared, solid state, acoustic wave and metal oxide semiconductors.

Sanitization

As used herein, sanitization means the generic principle of attempting to keep the unit relatively clean, sanitary, disinfected, and/or sterile from infectious, pathogenic, pyrogenic, etc. substances. Potentially harmful substances may reside in the unit because of a prior ambient introduction, from the fabrics cleaned, or from any other new substance added. Because of the desire to retrieve clean clothes from the unit after the cycles are over, the amount of contamination remaining in the clothes ought to be minimized. Accordingly, sanitization may occur due to features inherent in the unit, process steps, or sanitizing agents added. General sanitization techniques include glutaraldehyde tanning, formaldehyde tanning at acidic pH, propylene oxide or ethylene oxide treatment, gas plasma sterilization, gamma radiation, electron beam, ultraviolet radiation, peracetic acid sterilization, thermal (heat or cold), chemical (antibiotics, microcides, cations, etc.), and mechanical (acoustic energy, structural disruption, filtration, etc.).

As for inherent features, one method of sanitizing is to manufacture conduits, tanks, pumps, or the like with materials that confer sanitization. For example, these components may be manufactured and coated with various chemicals, such as antibiotics, microcides, biocides, enzymes, detergents, oxidizing agents, etc. Coating technology is readily available from catheter medical device coating technology. As such, as solvents are moving through the component, the solvents are in contact with the inner surfaces of the component and the coatings and thereby achieves contact based sanitization. For tanks, the inner surfaces of tanks may be provided with the same types of coatings thereby providing longer exposure of the coating to the solvent because of the extended storage times. Any coating may also permit elution of a sanitizer into the solvent stream. Drug eluting stent technology may be adapted to permit elution of a sanitizer, e.g., elution via a parylene coating.

Another inherent feature is to manufacture any surface by micro-texturing the surface. For example, it is known that certain organisms seek to adhere to surfaces and rough surfaces provide areas for adhesion. Accordingly, micro-texturing the surface to become very smooth eliminates any rough area where organisms can adhere. Components may also exist that specifically provide sanitization, For example, a UV light may be provided anywhere along the washing, drying, or reclamation cycles. One convenient location for the UV light can be at the entrance of the reclamation unit from the wash unit. As such, as solvent enters the reclamation unit from the wash unit, it is exposed to UV light prior to any initial reclamation steps. In addition, other locations may include prior to any filtration, upon exit of a tank, or anywhere where the conduit length is lengthy. Conduits may be made of a clear material wherever necessary to permit UV exposure.

Another component available for sanitization is a filter. The filter may be sized to permit continued progress of a desired permeate but trap undesirable concentrates. For example, filtration can include large size filtration, micro-filtration, ultra-filtration, or the like. As with any embodiment herein using filters, the filters may be sequential with varying filtering capabilities. For example, sequential filters may be used that have decreasing pore sizes. These pore size changing filters may also be stacked. In addition, to facilitate any filtration (e.g., in the wash unit or the reclamation unit), any particle may be subject to additional processing such as chopping, grinding, crushing, pulverizing, sonic pulverization, etc., to reduce the particle size.

In addition, various sanitization additives may be added to assist in periodic cleaning. For example, bleach, oxidizers, enzymes, acids, alkalis, degreasers, ozone, plus the other organism cleaners mentioned above, may be added to the wash chamber and the unit cycled. For example, ozone in a level greater than 1 ppm at less than 20° C. may be used.

The invention claimed is:

1. A solvent cleaning process of cleaning a non-aqueous solvent used in a dry cleaning process for fabrics, the dry cleaning process comprising consecutive wash cycles for washing respective fabrics batches, the solvent cleaning process occurring independent of the wash cycles and when the solvent fulfills a first predetermined condition, the solvent cleaning process comprising:

(a) a basic solvent refining cycle; and (b) a first advanced solvent refining cycle;

said basic solvent refining cycle comprising a step of separating the solvent into:

(i) a first solvent fraction; and (ii) a second solvent fraction which is less clean than the first fraction, by first reducing a temperature of the solvent below 0 degrees C. and then passing the cooled solvent through a cross-flow membrane filter;

said first advanced solvent refining cycle comprising a step of low temperature evaporation of the second solvent fraction at a temperature at least 16 degrees C. below a flash point of the solvent, and then condensing the evaporated second solvent fraction and delivering it to a clean solvent storage container, wherein the first advanced solvent refining cycle is effected independent of the basic solvent refining cycle when solvent to be cleaned fulfils a second predetermined condition.

2. A solvent process according to claim 1, wherein the average volume ratio of the first solvent fraction to the second solvent fraction is from 1:1 to 99:1.

3. A solvent cleaning process according to claim 1, wherein the first advanced solvent refining cycle is used to clean the second fraction when the second fraction fulfils said second predetermined condition.

4. A solvent cleaning process according to claim 1, including the step of employing a first replenishable means in the first advanced solvent refining cycle to be replenished when its cleaning ability falls below a first predetermined threshold.

5. A solvent cleaning process according to claim 1, wherein the first solvent fraction is cleaned with a second advanced solvent refining cycle when the first solvent fraction fulfils a third predetermined condition.

6. A solvent cleaning process according to claim 5, including the step of employing a second replenishable means in the second advanced solvent refining cycle to be replenished when its cleaning ability falls below a second predetermined threshold.

7. A solvent cleaning process according to claim 6, wherein the second replenishable means comprises a replaceable cartridge containing a solid absorption medium.

8. A solvent cleaning process according to claim 7, wherein the second replenishable means is replaced after more than 10 wash cycles.

9. A solvent cleaning process according to claim 5, wherein the second advanced solvent refining cycle comprises contacting the first solvent fraction with a solid absorption medium.

10. A solvent cleaning process according to claim 1, wherein any predetermined condition is selected from color, chemical composition, solids content, turbidity, dielectric constant, viscosity, odor and the elapsing of a predetermined number of wash cycles greater than one cycle.

11. A solvent cleaning process according to claim 10, wherein a predetermined condition is chemical composition and comprises water content.

12. A solvent process according to claim 1, wherein said cross-flow microfiltration membrane system has a trans-membrane pressure greater than 0.5 bar but less than 10 bar.

13. A solvent cleaning process according to claim 12, wherein the cross-flow microfiltration membrane system comprises a cross-flow membrane having a channel diameter greater than 1 mm but less than 25 mm.

14. A solvent cleaning process of cleaning a non-aqueous solvent used in a dry cleaning process for fabrics, the dry cleaning process comprising consecutive wash cycles for washing respective fabrics batches, the solvent cleaning process occurring when the solvent fulfills a first predetermined condition other than initiation or completion of a single wash cycle, the solvent cleaning process comprising:

(a) a basic solvent refining cycle; and (b) a first advanced solvent refining cycle;

said basic solvent refining cycle comprising the steps of first reducing a temperature of the solvent below 0 degrees C. and then filtering the solvent in a cross-flow microfiltration membrane and separating the solvent into:

(i) a first solvent fraction; and (ii) a second solvent fraction which is less clean than the first fraction;

wherein the first advanced solvent refining cycle is effected independent of the basic solvent refining cycle when solvent to be cleaned frilfils a second predetermined condition.

15. A solvent process according to claim 14, wherein said cross-flow microfiltration membrane system has a trans-membrane pressure greater than 0.5 bar but less than 10 bar.

16. A solvent cleaning process according to claim 15, wherein the cross-flow microfiltration membrane system comprises a cross-flow membrane having a channel diameter greater than 1 mm but less than 25 mm.

17. A solvent cleaning process according to claim 14, wherein the first advanced solvent refining cycle is used to clean the second fraction when the second fraction fulfils said second predetermined condition.

18. A solvent cleaning process according to claim 14, wherein the first solvent fraction is cleaned with a second advanced solvent refining cycle when the first solvent fraction fulfils a third predetermined condition.

19. A solvent cleaning process according to claim 18, wherein the second advanced cleaning cycle comprises contacting the first solvent fraction with a solid absorption medium.

20. A solvent cleaning process of cleaning a non-aqueous solvent used in a dry cleaning process for fabrics, the dry cleaning process comprising consecutive wash cycles for washing respective fabrics batches, the solvent cleaning process occurring when the solvent fulfills a first predetermined condition other than initiation or completion of a single wash cycle, the solvent cleaning process comprising:

(a) a basic solvent refining cycle; and (b) a first advanced solvent refining cycle;

said basic solvent refining cycle comprising the steps of separating the solvent into:

(i) a first solvent fraction; and (ii) a second solvent fraction which is less clean than the first fraction;

said first advanced solvent refining cycle comprising a step of low temperature evaporation of the second solvent fraction at a temperature at least 16 degrees C. below a flash point of the solvent, and then condensing the evaporated second solvent fraction and delivering it to a clean solvent storage container, wherein the first advanced solvent refining cycle is effected independent of the basic solvent refining cycle when solvent to be cleaned fulfils a second predetermined condition.

* * * * *